US010668365B2

(12) United States Patent
O'Connor

(10) Patent No.: US 10,668,365 B2
(45) Date of Patent: Jun. 2, 2020

(54) GAME BOARD WITH A PLAY SURFACE THAT IS MOVABLE AROUND A FIXED GAME PIECE AND RELATED BOARD GAME RULES

(71) Applicant: Martin Emory O'Connor, San Diego, CA (US)

(72) Inventor: Martin Emory O'Connor, San Diego, CA (US)

( * ) Notice: Subject to any disclaimer, the term of this patent is extended or adjusted under 35 U.S.C. 154(b) by 0 days.

(21) Appl. No.: 15/730,402

(22) Filed: Oct. 11, 2017

(65) Prior Publication Data

US 2018/0028902 A1 Feb. 1, 2018

Related U.S. Application Data

(63) Continuation of application No. 15/159,602, filed on May 19, 2016, now abandoned, which is a continuation-in-part of application No. 14/857,572, filed on Sep. 17, 2015, now abandoned, which is a continuation of application No. 14/181,959, filed on Feb. 17, 2014, now abandoned, which is a continuation of application No. 12/355,723, filed on Jan. 16, 2009, now abandoned.

(51) Int. Cl.
*A63F 3/02* (2006.01)
*A63F 3/00* (2006.01)

(52) U.S. Cl.
CPC ..... *A63F 3/02* (2013.01); *A63F 3/00176* (2013.01); *A63F 3/00697* (2013.01); *A63F 2003/00195* (2013.01); *A63F 2003/00716* (2013.01); *A63F 2003/00832* (2013.01)

(58) Field of Classification Search
CPC .... A63F 3/02; A63F 3/00697; A63F 3/00176; A63F 2003/00832; A63F 2003/00195; A63F 2003/00716
USPC ..... 273/241, 260, 261
See application file for complete search history.

(56) References Cited

U.S. PATENT DOCUMENTS

| | | | | |
|---|---|---|---|---|
| 4,436,309 A * | 3/1984 | Barlow | A63F 9/10 | 273/157 R |
| 4,699,385 A * | 10/1987 | Bifulco | A63F 3/0023 | 273/157 R |
| 5,108,109 A * | 4/1992 | Leban | A63F 3/0023 | 273/242 |
| 7,344,138 B2 * | 3/2008 | Romney | A63F 1/00 | 273/274 |
| 2005/0179203 A1 * | 8/2005 | Schroeder | A63F 3/00176 | 273/260 |
| 2012/0007309 A1 * | 1/2012 | Stanoch | A63F 3/00075 | 273/148 R |

* cited by examiner

*Primary Examiner* — Vishu K Mendiratta
(74) *Attorney, Agent, or Firm* — Buche & Associates, P.C.; John K. Buche; Bryce A. Johnson

(57) ABSTRACT

Disclosed is an amusement device having a board or other field and game-pieces movable over said board or field by contestants according to pre-set rules.

18 Claims, 12 Drawing Sheets

SIX IN A DREAM GAME PLAY RECORD DATE: GAME #:

MARK THE CORRECT BOX FOR EACH SWARM AT THE TIME OF A MOVE OR WHEN A CREDIT IS RECEIVED OR USED.

MOVE #: # OF SPACES GAME FINAL SCORE: LIGHT: HEAVY:

| | FOXY | VIX▼N | LIGHT SWARM | CREDITS (USED) | | | FIXES |
|---|---|---|---|---|---|---|---|
| M1:1S | ☐ | | | DOODLE | ☐ | ☐ | BROKEN: ☐ ☐ ☐ ☐ ☐ ☐ |
| M2:2S | ☐ | | | ODD | ☐ | ☐ | DE FACTO: ☐ |
| M3:3S | ☐ | | MOVED IM: ☐ | NOODLE | ☐ | ☐ | PERFECT: ☐ |
| M4:4S | ☐ | | | OFF | ☐ | ☐ | TOTAL POINTS: |
| M5:5S | ☐ | | | | | | |
| M6:5S, ETC. | ☐ | | | | | | |

REPLACEMENT MORX OFF-SOFFIT TRADES

| | DONKEY | OATEY | DOODLE | ODD | NOODLE | EARFUL | DONKEY | OATEY | EARFUL | DONKEY | OATEY |
|---|---|---|---|---|---|---|---|---|---|---|---|
| M1:1S OR 2S | ☐ | M M | M M | M M | M M | M M | M M | | M M | M M | |
| M2:1S OR 2S | ☐ | 14 25 | 14 25 | 14 25 | 14 25 | 14 25 | 14 25 | | 14 25 | 14 25 | |
| M3/14/25:4S | ☐ | ☐ ☐ | ☐ ☐ ☐ | ☐ ☐ ☐ | ☐ ☐ ☐ | ☐ ☐ | ☐ ☐ | | ☐ ☐ | ☐ ☐ | |
| M4/15/26:3S | ☐ | ☐ ☐ | ☐ ☐ ☐ | ☐ ☐ ☐ | ☐ ☐ ☐ | ☐ ☐ | ☐ ☐ | | ☐ ☐ | ☐ ☐ | |
| M5/16/27:5S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M6/17/28:6S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M7/18/29:4S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M8/19/30:8S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M9/20/31:6S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M10/21/32:5S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M11/22/33:3S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M12/23/34:4S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M13/24/35:2S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |

M14: REPEAT FROM M3:4S M25: REPEAT FROM M3:4S

| | FOXY | VIX▼N | HEAVY SWARM | CREDITS (USED) | | | FIXES |
|---|---|---|---|---|---|---|---|
| M1:1S | ☐ | | | DOODLE | ☐ | ☐ | BROKEN: ☐ ☐ ☐ ☐ ☐ ☐ |
| M2:2S | ☐ | | | ODD | ☐ | ☐ | DE FACTO: ☐ |
| M3:3S | ☐ | | MOVED IM: ☐ | NOODLE | ☐ | ☐ | PERFECT: ☐ |
| M4:4S | ☐ | | | OFF | ☐ | ☐ | TOTAL POINTS: |
| M5:5S | ☐ | | | | | | |
| M6:5S, ETC. | ☐ | | | | | | |

REPLACEMENT MORX OFF-SOFFIT TRADES

| | DONKEY | OATEY | DOODLE | ODD | NOODLE | EARFUL | DONKEY | OATEY | EARFUL | DONKEY | OATEY |
|---|---|---|---|---|---|---|---|---|---|---|---|
| M1:1S OR 2S | ☐ | M M | M M | M M | M M | M M | M M | | M M | M M | |
| M2:1S OR 2S | ☐ | 14 25 | 14 25 | 14 25 | 14 25 | 14 25 | 14 25 | | 14 25 | 14 25 | |
| M3/14/25:4S | ☐ | ☐ ☐ | ☐ ☐ ☐ | ☐ ☐ ☐ | ☐ ☐ ☐ | ☐ ☐ | ☐ ☐ | | ☐ ☐ | ☐ ☐ | |
| M4/15/26:3S | ☐ | ☐ ☐ | ☐ ☐ ☐ | ☐ ☐ ☐ | ☐ ☐ ☐ | ☐ ☐ | ☐ ☐ | | ☐ ☐ | ☐ ☐ | |
| M5/16/27:5S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M6/17/28:6S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M7/18/29:4S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M8/19/30:8S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M9/20/31:6S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M10/21/32:5S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M11/22/33:3S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M12/23/34:4S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |
| M13/24/35:2S | ☐ | ☐ ☐ | ☐ ☐ ☐ | ☐ ☐ ☐ | ☐ ☐ ☐ | ☐ ☐ ☐ | ☐ ☐ ☐ | | ☐ ☐ ☐ | ☐ ☐ ☐ | |

M14: REPEAT FROM M3:4S M25: REPEAT FROM M3:4S

*FIG. 5*

GAME BOARD WITH A PLAY SURFACE THAT IS MOVABLE AROUND A FIXED GAME PIECE AND RELATED BOARD GAME RULES

CROSS-REFERENCE TO RELATED APPLICATIONS

This application is a continuation-in-part of application Ser. No. 12/355,723 (filed Jan. 16, 2009), Ser. No. 14/181,959 (filed Feb. 17, 2014), and Ser. No. 14/857,572 (filed Sep. 17, 2015) for "Board Game: Six In a Dream." The previous applications are hereby incorporated by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND AN INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The following relates generally to amusement devices having a board or other field where the board or field is movable relative to a fixed obstruction and where game-pieces are movable over said board or field by opposing players according to pre-set rules.

Background of the Invention

Typically, board-games within the genre of the present application involve a turn by-turn contest between opponents who each control the movement of a set of hierarchal game-pieces, one game-piece at a time, throughout a playing board or field. Normally, the field has a finite number of locations where game-pieces may be positioned, and opposing game-pieces are captured (i.e., removed from the board or field) by moving an allied game-piece to a terminal location occupied by said opposing game-piece. Generally, game-pieces are strategically positioned, captured, sacrificed, and exchanged until an opponent's hierarch game-piece is captured and the capturer is declared the winner.

One short-coming of games presently known in this art is that the layout of the field or board remains the same throughout any given contest. In other words, the finite locations within the field whereon game-pieces may be positioned remain the same throughout a game. Such a non-changing layout leads to monotony in game-play and imposes a ceiling on the game-strategy. Some have attempted to solve this problem by blacking-out locations on a board whereby game-pieces may not occupy or move past the blacked-out locations. See U.S. Pat. No. 1,056,526 (the central location on the field is blacked-out). While such a feature may modify the board, the field locations for game-piece positioning are not dynamic and the problem of a strategy ceiling is not solved. Still, others have attempted to solve this problem by introducing additional contestants into the game whereby contestants are eliminated until two remain, and wherein the game-pieces of the eliminated contestants become immovable and black-out the locations which they occupied at elimination of their controller. See U.S. Pat. No. 3,963,242. Such a solution is inadequate because during the contest, the board layout remains the same to the participating contestants, just as before.

Another shortcoming of games presently known in this art is that a contestant's game-pieces may only be captured or removed from the board or field at the election of the opponent. Adding an additional option wherein a contestant may electively capture or remove allied game-pieces would provide a beneficial component for strategizing victory, and increase the intellectual stimulation of the game.

Yet another shortcoming of games presently known in this art is that contestants may only move or manipulate allied game-pieces. There is a need for an additional option wherein a contestant may electively move or manipulate opposing game-pieces. This option would provide an additional component for strategizing victory, and increase the intellectual stimulation of the game. Furthermore, such a feature would bring the element of sabotage to bear on the opposition's game-play strategy.

Yet still, another shortcoming of games presently known in this art is that each game-piece typically has a predetermined move path that does not change adequately throughout the game. There is a need for a game feature of additional option wherein game-piece movement or move path is dependent on other game elements, for instance the frequency by which a game-piece is utilized, would increase the intellectual stimulation of the game.

Another shortcoming of games presently known in this art is that typically only one allied game-piece may be moved at a time, rather than at least two simultaneously. Movement of one game-piece at a time slows the speed of the game and prevents any single move from being more valuable than any other move of the same game-piece. Furthermore, there is a need for an additional option wherein more than one game-piece may be moved simultaneously.

Another shortcoming of games presently known in this art is that game outcomes frequently depend only on the capturing of one game-piece. For instance, a winner in chess is only determined by capturing the opponent's king. Games of this type may end in a draw or stalemate. It is not desirable to have outcomes where no one is declared a winner.

SUMMARY OF THE INVENTION

Accordingly, it is an object of the present application to provide a board game wherein the area for game-piece movement is effectively dynamic.

It is a further object of the present application to provide a board game wherein a contestant's game-pieces may be electively captured or removed from the board or field at the election of the opponent or the contestant.

Yet another object of the present application is to provide a game wherein contestant may capture, remove, move, or manipulate allied game-pieces as well as the opponent's game-pieces.

Yet another object of the present application is to provide a game wherein each game-piece may have a predetermined move path that does not change throughout the game, or a sequence of possible moves which depend on the frequency by which the particular game-piece has been utilized during game play.

Yet another object of the present application is to provide a game wherein more than one allied game-piece may occupy any one of the finite locations within the board or field.

Yet another object of the present application is to provide a game wherein more than one allied game-piece may be moved at a time.

Yet still, another object of the present application is to provide a game wherein game outcomes may be determined by means other than which player captured the opponent's hierarch game-piece.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

Table 5 is an example of a game play record which may be used during any given contest to record important game information.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PROFFERED EMBODIMENTS

Overview. In general, the game of the present application is suitably a recreational and competitive one-on-one contest between players who each alternatingly and strategically manipulate respective sets of hierarchically valued game-pieces. The game-pieces are movable, turn-by-turn according to pre-set parameters, over a field. Each respective contestant begins with a set of twenty-four game-pieces, distinguishable by color (usually light versus dark) and preferably consisting of different game-piece classes. Each game-piece class is hierarchically distinguished by shapes, and usually features its own respective movement styles/capabilities, upgrade/modifying potential, and game importance. Allied or rival game-pieces are respectively and electively captured (i.e., removed from the game-board) as a consequence of game-piece movements. However, points are only earned by endangering the rival hierarch game-piece for capture. A game ends when an adversary's hierarch game-piece cannot avoid capture in a single move after the first threat of capture, or when the contestant with the fewest points concedes. Ultimately, a win is awarded to the contestant having the most points.

Figure 1:
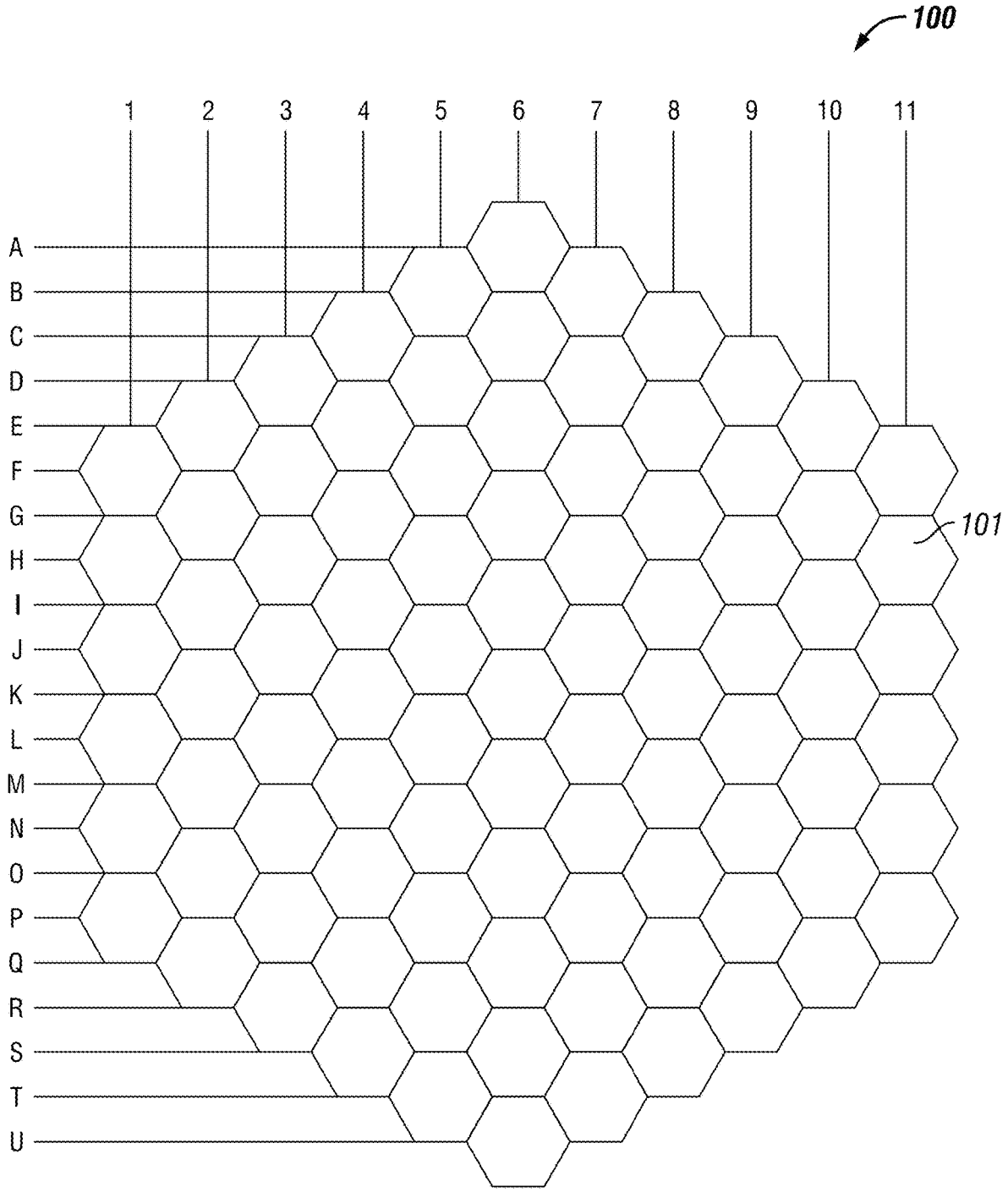
FIG. 1 is a top view of the hexagonal field 100, defined by columns 1 through 11 and rows A through U of hexagons 101.

The Field of Play. FIG. 1 is the top view of a field of play 100 which signifies a predetermined area that confines the game and which determines a finite number of potential game-piece positions. As depicted by this figure, the field 100 is generally hexagonal and defines a pattern of ninety-one tessellated hexagons 101, situated whereby six of the tessellated hexagons 101 occupy each side of the hexagonal field 100. During a game, all active game-pieces must be positioned on a hexagon 101, and generally, the contestants manipulate the location of their game-pieces, per turn, by moving pieces between a start hexagon 101 and a terminal hexagon 101. Subject thereto, each hexagon 101 may, in the atypical game-play scenario discussed later below, accommodate two or more allied game-pieces.

FIG. 1 also illustrates the coordinate system for the specific identification of each of the ninety-one hexagons 101 within the field 100. More specifically, each hexagon 101 is suitably identified with a respective point on the coordinate plane. The numbers 1 through 11, moving from left to right in FIG. 1, identify respective hexagon 101 columns; and, the letters A through U, moving from top to bottom in FIG. 1, identify respective hexagon 101 rows. Accordingly, any number and letter combination falling within the stated ranges identifies a specific hexagon 101. For example, the center hexagon 101 corresponds to 6K. This coordinate system allows players to fully articulate game-piece movement within the field 100, including possible computer programming commands. It is contemplated that this game is susceptible to board play or play via computer means.

General Game-Piece Movement. As stated above, the game of the present application contemplates the strategic manipulation of the game-pieces over the field 100, between a start hexagon 101 and terminal hexagon 101. The start hexagon 101 is determined by the pre-move location of the game-piece. The terminal hexagon 101 is essentially defined by two components: movement style; and, movement duration. The movement style suitably dictates how a game-piece moves from hexagon-to-hexagon 101. The movement duration dictates how far (i.e., how many hexagons 101) a game-piece travels during a single move. As discussed below, the different classes of game-pieces have different restrictions regarding movement style and movement duration.

Figure 2:
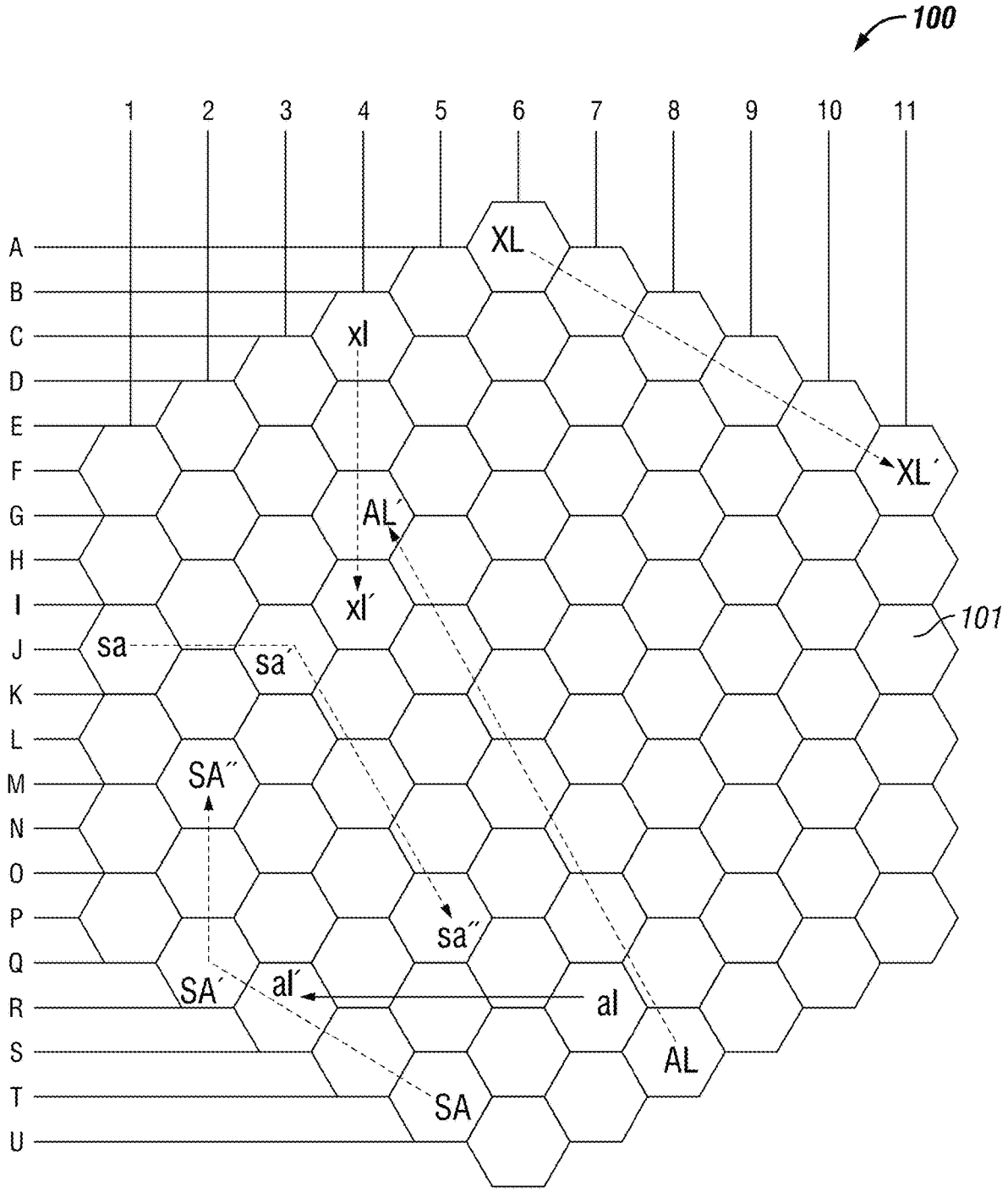
FIG. 2 is a top view of the hexagonal field 100 depicted in FIG. 1, and shows basic movement paths and styles of the game.

FIG. 2 depicts the field 100 as previously shown in FIG. 1 and illustrates the basic game-piece movement styles with arbitrary movement durations. As illustrated by the figure, game-piece movement and position manipulation are confined to the field 100, wherein essentially three general types of hexagon-to-hexagon 101 movements are permissible depending on game-piece classification. In other words, during a contest, players will alternatingly manipulate the positions of their game-pieces (usually one at a time but sometimes more than one at a time) generally according to the below stated conventions.

The first type of game-piece movement, illustrated by FIG. 2, is "across lines," wherein game-pieces move in a single direction to a terminal hexagon 101 across the mutual sides of the traversed hexagons 101. In the figure, the "across lines" movement is typified by a game-piece moving five hexagons 101 from start 6A to terminal 11F (line XL to XL') or a game-piece moving three hexagons 101 from start 4C to terminal 4I (line xl to xl'). The second basic game-piece movement, illustrated by FIG. 2, is "along lines," wherein game-pieces move to a terminal hexagon 101 in a single direction along the point-to-point line of non-adjacent hexagons 101. In the figure, the "along lines" movement is typified by a game-piece moving four hexagons 101 from start 8S to terminal 4G (line AL to AL') or a game-piece moving two hexagons 101 from start 7R to terminal 3R (line al to al'). Finally, the third basic game-piece movement, illustrated in the figure, is "shallow angled," wherein game-pieces move "along lines" or "across lines," but change direction by a single shallow angle mid-move. For example, in the figure, the "shallow angled" movement is typified by a game-piece moving three hexagons 101 from start 5T to 2Q and two hexagons 101 from 2Q to terminal 2M (line SA to SA' to SA"), or a game-piece moving one hexagon from start 1J to 3J and two hexagons from 3J to terminal 5P (line sa to sa' to sa").

Unlike movement style (which involves the path of the game-piece), movement duration (the number of hexagons 101 traveled by a game-piece) is influenced by many considerations. First, the start hexagon 101 of the moving game-piece is a factor since a game-piece is confined by the perimeter of the field 100. Accordingly, any game piece may only have a movement duration which results in a terminal hexagon 101 within the field 100. Second, in general, game-pieces may not move through hexagons 101 which are occupied by rival game-pieces (but discussed later below are game-piece classifications which "jump" or move over game-pieces in the move path). Therefore, a moving game-piece's movement duration generally must either: produce a terminal hexagon 101 whereon the rival game-piece is located (this results in game-piece capture as discussed below); or, produce an unoccupied terminal hexagon 101 in between the start hexagon 101 and the rival game-piece on the given move path. Third, some game-piece classifications have mandatory movement durations, as discussed below. Fourth, game-piece movement may not generally move past or through a neutral knocker 102 game-piece discussed further below. Finally, a contestant's game strategy will affect the movement duration of any given move.

General Game-Piece Capture. In general, non-moving allied and rival game-pieces may be strategically captured (i.e., removed from the field 100) as the result of game-piece movements. The mechanisms for capturing rival versus allied game-pieces are different than those for capturing allied versus allied game-pieces. Additionally, with a few exceptions discussed below, both allied and rival game-pieces may not be removed as the result of one turn (i.e., only allied or only rival game-pieces can be removed on any one turn).

Figure 3:
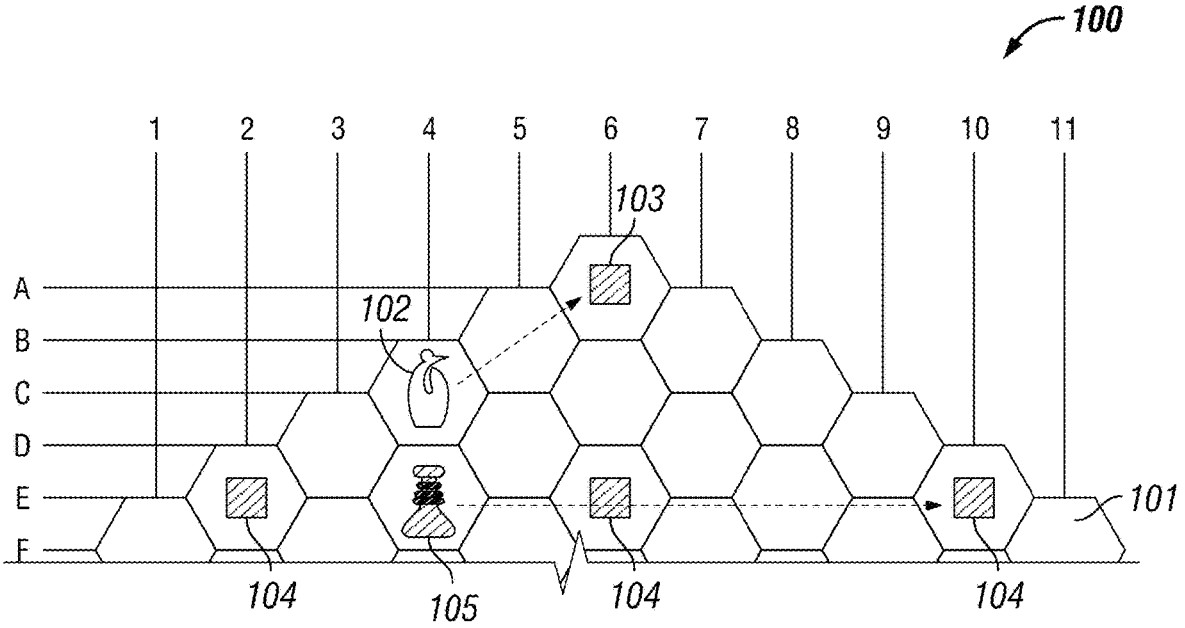
FIG. 3 depicts a selected segment of the field 100 and illustrates generally the removal of rival game-pieces.

FIG. 3 depicts a selected segment of the field 100 and illustrates generally the mechanism for capturing rival game-pieces. Rival game-pieces are captured when positioned at the terminal hexagon 101 of an allied game-piece. As seen in FIG. 3, the light game-piece 102 captures the rival dark game-piece 103 by moving to from 4C to terminal 6A (4C×6A). Whenever, in the rare circumstance, two or more allied game pieces occupy the terminal hexagon 101 of a rival, all allied game-pieces are captured.

During any given move, a contestant may select a route whereby the capturing of a rival game-piece(s) is avoided. However, a rival game-piece may not typically be "jumped" (i.e., passed-over) by an allied game-piece move path. Instead, the move must either terminate at the rival game-piece or at a terminal hexagon 101 preceding the rival game-piece in the move line (i.e., a shorter movement duration). Subject thereto, some game pieces may "jump" rival game-pieces.

Allied game-pieces may be captured in a number of ways. First, an allied game-piece may be electively removed from the field 100, as a turn, instead of repositioning a game-piece. Second, some or all allied game-pieces that are within the move line or at the terminal hexagon 101 of the moving game-piece may be removed as part of the turn. The move line is the line created by extending the move path to either: the field 100 perimeter; a rival game-piece; a non-removable allied game-piece (discussed below); or the neutral knocker 102 (discussed below). During a move, allied game-pieces at the terminal hexagon must be captured. Within the move line, allied game-pieces between the start and terminal hexagons 101 must be captured. By contrast, allied game-pieces within the move line but not between the start and terminal hexagons 101 may be captured at the election of the moving player. Finally, some game pieces "jump," instead of capture, the allied game-pieces between the start and terminal hexagons 101.

FIG. 3 illustrates the removal of allied game pieces. As seen in FIG. 3, the three dark game-pieces 104 occupying 2E, 6E and 10E, are in the move line (in this instance, the E row) of another dark game-piece 105 as it moves from start 4E to terminal 10E. This move typically results in mandatory removal of the dark game-pieces 104 occupying 6E and 10E. The moving player may elect to, but need not, remove the dark game-piece 104 occupying 2E as part of the same move.

Rival and allied game pieces may not be removed as part of the same turn. Accordingly, with a few exceptions discussed below in connection with game piece classification, removing one or more allied game-pieces during a turn prevents the capture of a rival game-piece. In other words, a contestant must select a move path whereby allied game-piece removal is avoided in order to capture a rival game-piece.

Game-Piece Classifications. Each set of rival and allied game-pieces feature a number of different classifications. Game-piece classification determines game-piece initial positioning, movement style, movement duration, allied game-piece removal capabilities, upgrade potential (the ability to have abilities modified), and strategic value. The classification of any given game-piece is preferably identifiable via the shape of the game-piece, since each classification has at least one distinguishing shape. The game of the present application has eight basic game-piece classifications and the characteristics of each class are depicted in FIGS. 4*a* through 4*d*. It should be noted that, while the game-pieces may feature stylized names and shapes, for purposes of this application the important consideration is the function and the play attributes of the various pieces. In other words, the styles of the pieces are not necessarily intended as a limitation of the scope of this application.

1. The Drone 200.

Figure 4A:
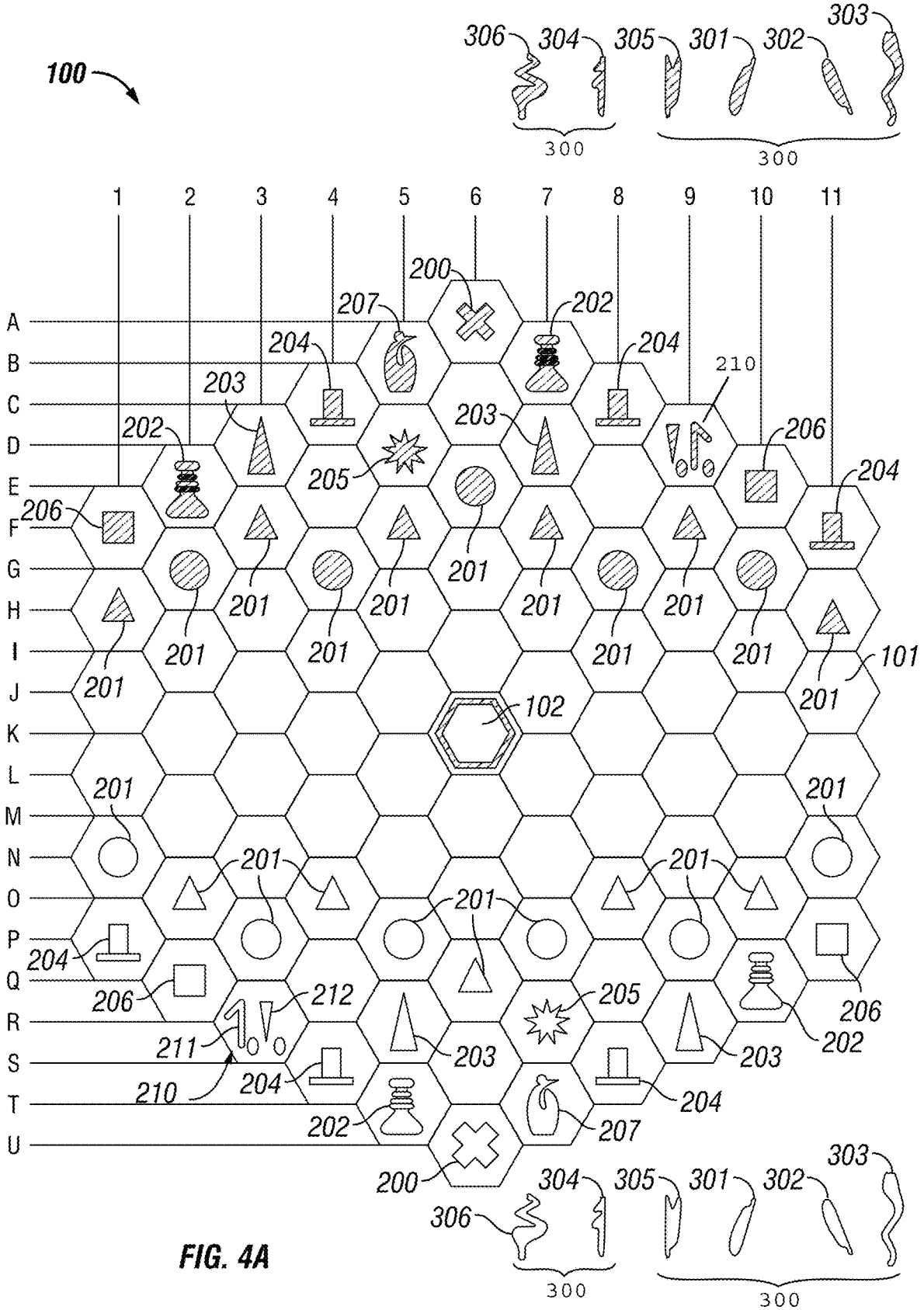
FIG. 4A depicts the field 100 and illustrates the initial positioning of the game-pieces during a contest.
Figure 4B:
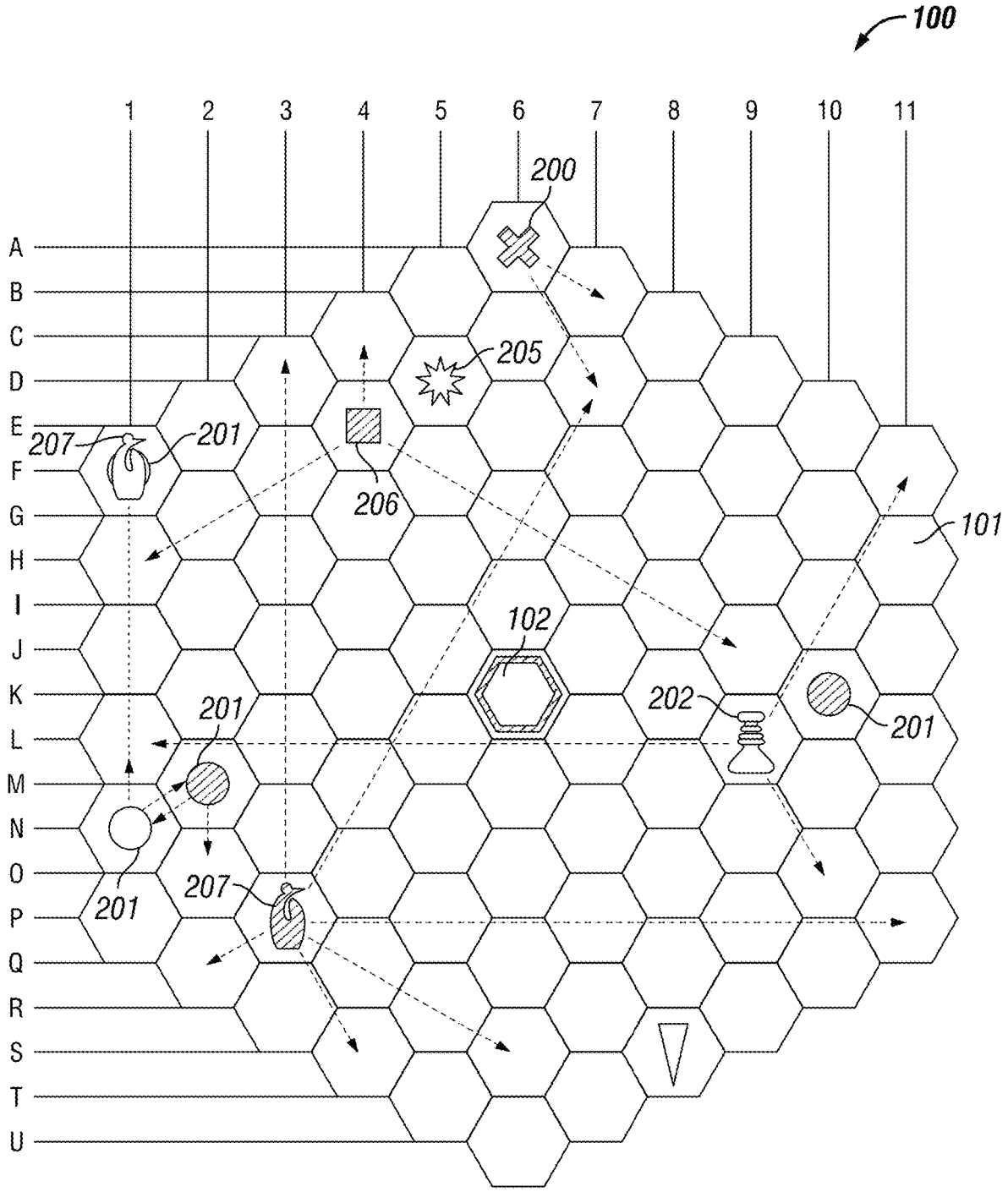
FIG. 4B depicts the movement of the particular game-pieces.

Each set of allied and rival game-pieces suitably features a single drone 200. The drone 200 is identified by the shape of a flying cross, as depicted in the FIGS. 4*a* and 4*b*. The drone 200 is the hierarch game-piece, and game-play centers around collecting points by placing the opposing drone 200 in danger of capture. As seen in FIG. 4*a*, the drone 200 is initially positioned at the point of the field 100 behind all other game-pieces (light=6U; Dark=6A; or, vice versa). As illustrated by FIG. 4*b*, a drone 200 may move one hexagon 101 in any direction "across lines" or "along lines." The drone 200 is not upgradable. Movement of a drone 200 may result in the capture of rival or allied game-pieces. However, a drone 200 can neither be captured by the movement of an allied game-piece nor be captured in lieu of game-piece movement.

2. The Nix 201.

Each set of allied and rival game-pieces suitably feature eleven nix 201. The nix 201 may be identified by the shape of a circle or obtuse triangle, as seen in FIGS. 4*a* through 4*d*. The nix 201 are the front line of defense for the allied drone 200, or short-range infantry for endangering the rival drone 200. As seen in the FIG. 4*a*, the nix 201 are, at the outset of the game, opposingly positioned to the rival game-pieces, one per column in front of the other allied game-pieces ((light=1N, 2O, 3P, 4O, 5P, 6Q, 7P, 8O, 9P, 10O, 11N; Dark=1H, 2G, 3F, 4G, 5F, 6E, 7F, 8G, 9F, 10G, 11H; or, vice-versa).

As illustrated by FIG. 4*b*, a nix 201 may generally only move one hexagon 101 (or two as a first move) columnarly "across lines" toward the opponent (i.e., forward, 1N to 1L). However, the nix 201 may only capture a rival game-piece (s) at one hexagon 101 away in a forward "shallow angle" (for example 1N×2M in FIG. 4*b*). As part of the same turn which achieves advancement of the nix 201 to the rival end of any column (for example, 1H to 1F in FIG. 4*b*), or any time thereafter, each individual nix 201 may either be: (1) upgraded to any other allied game-piece; (2) swapped locations with an un-captured allied game-piece; (3) traded for a captured allied monad combined with an allied morx 300 (discussed below); or (4) traded for an allied morx 300 which may be combined with any un-captured allied monad (discussed later below).

3. The Monads: the Engineer 202, the Scientist 203, and the Politician 204.

Each set of allied and rival game-pieces suitably feature seven monad game-pieces. For example, the light and dark game-piece sets of the present embodiment feature two engineers 202, two scientists 203, and three politicians 204. The engineer 202, the scientist 203, and the politician 204 are usually identified, respectively, by the shape of a spark plug, a cone, and a top hat, as seen in FIGS. 4*a* and 4*b*. The monads are primarily long-range offensive (i.e., attack) units for capturing rival game-pieces. Monads generally have minor defensive value for reasons discussed further below. As seen in the FIG. 4*a*, the monads are initially positioned behind the nix 201 at the respective corners of the field 100 in the same relative positions as, but not mirrored to, the rival monad game-pieces (dark may=engineers 202 at 2E and 7B, scientist 203 at 3D and 7D, politician 204 at 4C, 8C and 11F; and, light may=engineers 202 at 5T and 10Q, scientist 203 at 5R and 9R, politician 204 at 1P, 4S and 8S).

As illustrated by FIG. 4*b*, a monad, for example the depicted engineer 202, may move one or more hexagons 101 in any direction "along lines" (for example 9L to 1L; 9L to 11F; 9L to 10O; or, et cetera). Monads follow standard capture procedure and do not "jump" game-pieces. As mentioned above, the monads have minor defensive value since the "along lines" movement does not allow the monad game-pieces to endanger rival game-pieces in the hexagon 101 immediately adjacent to their position. For example, the engineer 202 depicted in FIG. 4*b* on 9L cannot capture the rival nix 201 on 10K. The monad game-pieces are upgradable to an astrix 400 as discussed below.

4. The Pirouette 205 and the Bureaucrat 206.

Each set of allied and rival game-pieces suitably feature one pirouette 205 and two bureaucrat 206 game-pieces. The pirouette 205 and the bureaucrat 206 are usually identified, respectively, by the shape of a twirling top and a square, as seen in FIGS. 4*a* and 4*b*. These game-pieces are long-range offensive units for endangering the rival game-pieces, but these game-pieces are also strong defensemen for reasons discussed below. As seen in the FIG. 4*a*, the single pirouette 205 and the two bureaucrats 206 are initially positioned behind the nix 201 and among the monads, in the same relative positions as, but not mirrored with, the equivalent rival game-pieces (dark may=pirouette 205 at 5D and bureaucrat 206 at 1F and 10E; and, light may=pirouette 205 at 7R and bureaucrat 206 at 2Q and 11P).

As illustrated by FIG. 4*b*, a pirouette 205 or bureaucrat 206, for example the depicted bureaucrat 206, may move one or more hexagons 101 in any direction "across lines" (for example 4E to 4C; 4E to 9J; 4E to 1H; or, et cetera). The pirouette 205 and bureaucrat 206 follow standard capture procedure and do not "jump" game-pieces. As mentioned above, these game-pieces have major defensive capabilities and value since the "across lines" movement permits the endangerment of rival game-pieces in the hexagons 101 immediately adjacent to their position. For example, the bureaucrat 206 depicted in FIG. 4*b* on 4E may capture the rival pirouette 205 on 5D.

5. The Tor Mentor 207.

Each set of allied and rival game-pieces suitably feature one Tor Mentor 207. The Tor Mentor 207 is usually identified by the shape of a bottle opener, as seen in FIGS. 4*a* and 4*b*. This game-piece is the most capable game-piece. As seen in the FIG. 4*a*, the Tor Mentor 207 is initially positioned behind the nix 201 and next to the allied drone 200 (light=7T; and, dark=5B). As illustrated by FIG. 4*b*, the Tor Mentor 207 may move one or more hexagons 101 in any direction "across lines" or "along lines" (for example 3P to 3D; 3P to 7D; 3P to 11P; 3P to 6S; 3P to 4S; 3P to 2Q; or, et cetera). The tor mentor 207 follows standard capture procedure and does not "jump" game-pieces. As mentioned above, these game-pieces have the most capabilities since the "across lines" and "along lines" movement permits the endangerment of game-pieces on all the hexagons 101 within the Tor Mentor's 207 radial vicinity.

6. The Foxy Vix'n Donkey Oatey 210.

Each set of allied and rival game-pieces suitably feature one Foxy Vix'n Donkey Oatey 210. The Foxy Vix'n Donkey Oatey 210 is a split personality game-piece whose personalities manifest at different times of the game, depending on different facts and circumstances discussed below. The Foxy Vix'n personality 211 is usually identified by the shape of a downwardly pointing triangular head, while the Donkey Oatey personality 212 is usually identified by the shape of an upwardly pointing tail, as seen side-by-side in FIGS. 4*a* and 4*b*. As depicted in FIG. 4*a* the Foxy Vix'n Donkey Oatey 210 is usually initially positioned on the player's left side, behind the nix 201, and among the monad and bureaucrat 207 game-pieces (light=3R; and, dark=9D).

a. The Foxy Vix'n 211 Personality.

A foxy vix'n 211 may move in any direction straight "across lines," or "shallow angled" "across lines." Subject thereto, the foxy vix'n 211 "jumps" non-moving game-pieces and may only capture rival or allied game-pieces at her terminal hexagon 101. Furthermore, the movement duration for foxy vix'n 211 is preset and depends on the number of times foxy vix'n 211 has previously been moved since the most recent appearance of the foxy vix'n on the field 100. The foxy vix'n's 211 first movement is one hexagon 101; second, two hexagons 101; third, three hexagons 101; fourth, four hexagons 101; and, five hexagons for any move thereafter. To facilitate player recognition of the mandatory movement duration for each foxy vix'n 211 move, a game play record may be kept wherein the number of previous foxy vix'n 211 moves, up to at least the first five movements, is preferably logged. As an added benefit of the record, a contestant may state his or her desired move before executing it so the opposing player may judge the propriety of the move. FIG. 5 is an example of such a game record.

Figure 4C:
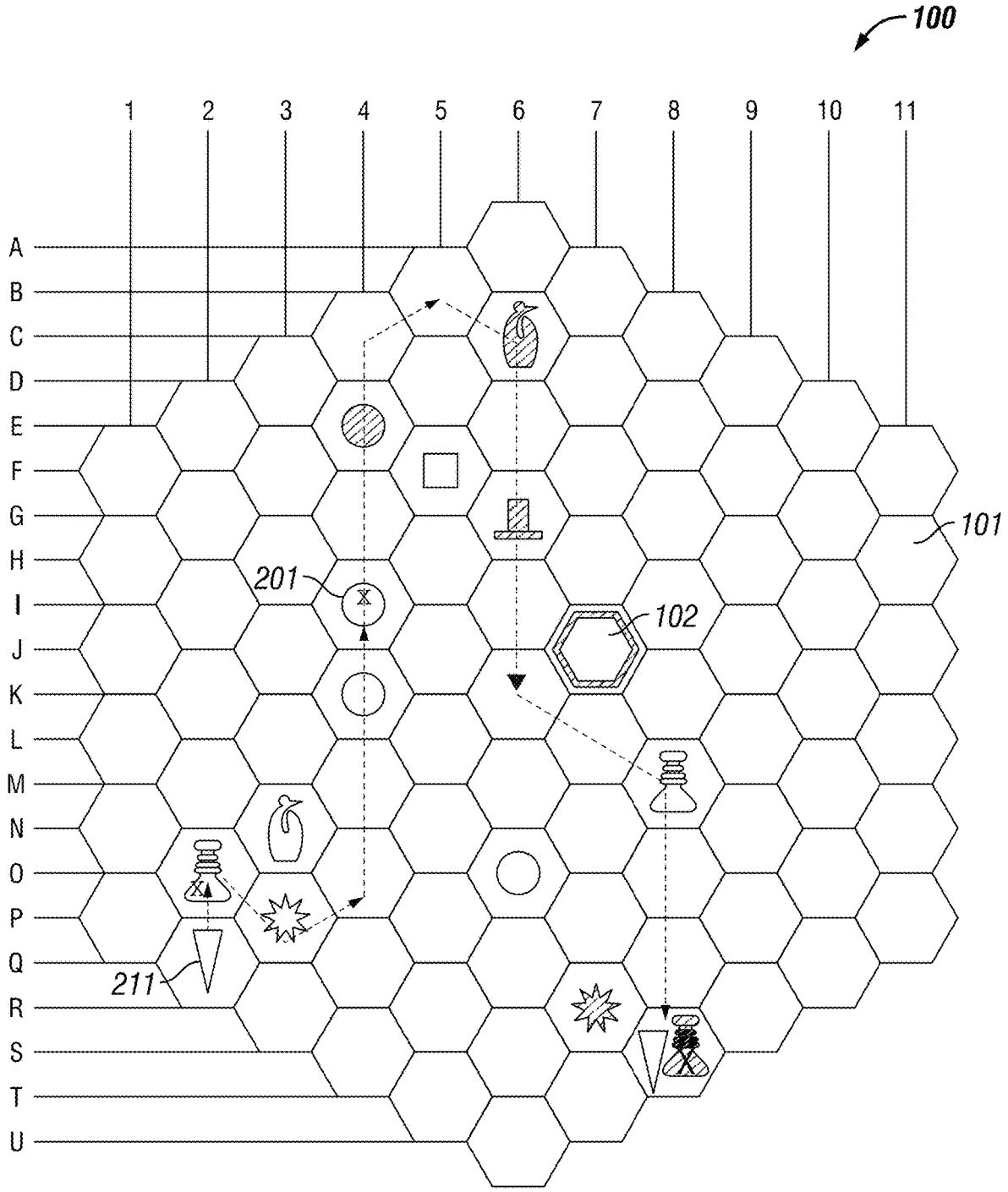
FIG. 4C depicts the movement of the foxy vix'n 211 game-piece.

As seen in FIG. 4*c*, the foxy vix'n 211 "jumps" game-pieces, whereby only game-pieces on her terminal hexagon 101 are removed or captured. Although foxy vix'n 211 must remove rival game-pieces occupying foxy vix'n's 211 terminal hexagon 101, the foxy vix'n 211 may elect to share its terminal hexagon 101 with an allied astrix 500, donkey oatey 212, or donkey oatey 212 on a supported game-piece (all discussed further below), rather than removing the game-pieces from the field 100. Once together on the same hexagon 101, both the foxy vix'n 211 and the other companion pieces (discussed below) may electively move simultaneously in a single turn so long as neither game-piece violates its respective movement parameters. It should be noted that a foxy vix'n 211 and companion game-piece (discussed below) moving in concert may remove both allied and rival game pieces during a single turn. This mechanism does not violate the previous rules stated above since the foxy vix'n 211 is deemed to capture the rival piece at the terminal hexagon 101 and the astrix 400 (discussed below) is deemed to capture the allied pieces in the move line.

To illustrate foxy vix'n movements, FIG. 4*c* depicts one possible sequence of six moves: 2Q×2O; 2O-4O; 4O×4I; 4I-5B; 5B-6K; and, 6K×8S.

b. The Donkey Oatey 212 Personality.

Like the foxy vix'n 211, a donkey oatey 212 may move in any direction straight "across lines" or "shallow angled" "across lines." The donkey oatey 212 may not capture rival game-pieces except for those at the donkey oatey's 212 terminal hexagon 101. However, unlike the foxy vix'n 211, donkey oatey 212 may, but need not, remove allied game-pieces within its move line. Also unlike foxy vix'n 211, the donkey oatey 212 takes all possible move paths to its terminal hexagon 101, simultaneously. Accordingly, any allied game-pieces may be electively removed along all possible donkey oatey 212 move paths.

The donkey oatey 212 follows mandatory movement durations, per turn, which are preset and depend on the number of times donkey oatey 212 has previously been moved since its most recent appearance on the field 100. Donkey oatey's 212 first and second movements are both electively one or two hexagons 101; its third, four hexagons 101; fourth, three hexagons 101; its fifth, five hexagons 101; its sixth, six hexagons 101; its seventh, four hexagons 101; its eighth, eight hexagons 101; its ninth, six hexagons 101; its tenth, five hexagons 101; eleventh, three hexagons 101; twelfth, four hexagons 101; thirteenth, two hexagons 101; and fourteen, begin a repeat of the sequence starting at the third move. To facilitate player recognition of the mandatory movement duration for each move, a game play record may be kept wherein the number of times the donkey oatey 212 has been moved is preferably logged. Furthermore, the players could state their desired move before executing it whereby the opposition may check the record and judge the propriety of the stated move before execution thereof. An example of such a game-play record has been provided in FIG. 5.

A consequence of mandatory movement durations beyond five hexagons is that positioning the donkey oatey 212 game-piece near the center of the field before such lengthy moves could potentially result in a donkey oatey 212 stalemate. A donkey oatey 212 stalemate results where no terminal hexagons 101 are available to accommodate the mandatory move duration of the game-piece. For instance, a donkey oatey 212 at start 6K on its sixth, eighth, or ninth move has no potential terminal hexagons 101 and must remain indefinitely on 6K. A donkey oatey 212 stalemate may be broken in a number of ways discussed below.

Figure 4D:
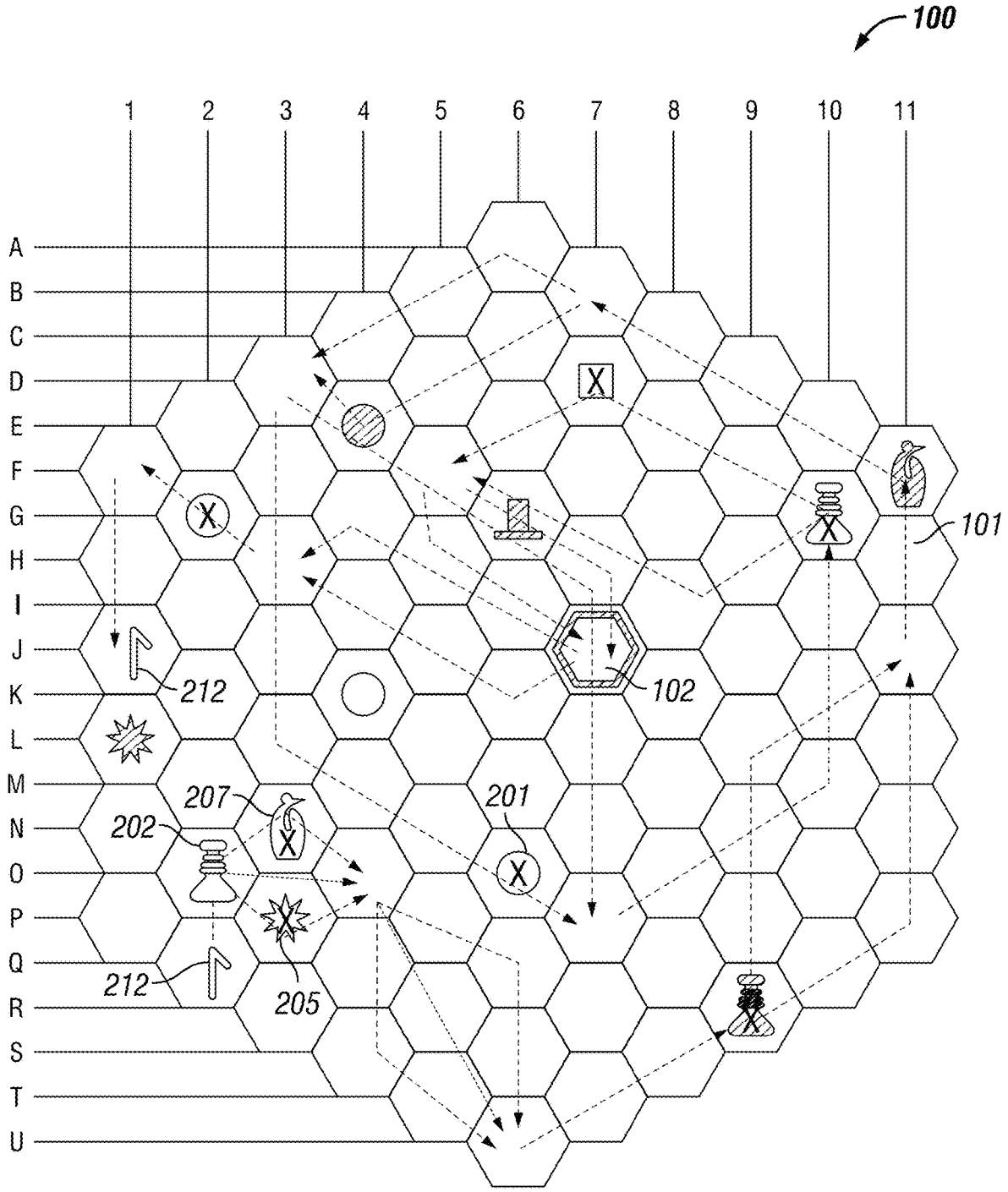
FIG. 4D depicts the movement of the donkey oatey 212 game-piece.

During movement as seen in FIG. 4*d* and like the foxy vix'n 211, the donkey oatey 211 "jumps" rival game-pieces during a move. Allied game-pieces in its move path, on the other hand, may be electively jumped or captured along all possible move paths. The donkey oatey 212 must take rival game-pieces at the terminal hexagon 101. Donkey oatey 212 may electively share a terminal hexagon 101 with an allied game-piece whereby both game-pieces may move in concert in subsequent turns, so long as neither game-piece violates their respective movement rules. Otherwise, the pieces must be moved separately over multiple turns.

To illustrate donkey oatey 212 movements, FIG. 4*d* depicts one possible sequence of fourteen moves: 2Q-2O; 2O-4O(×3N, 3P, and 6O); 4O-6U; 6U×9R; 9R-11J; 11J-11F; 11F-7B; 7B-3D; 3D-7P; 7P×10G; 10G-5F(×7D); 5F-7J; 7J-3H; 3H-1F(×2G); and, 1F-1J. As seen in the figure, on the first turn, donkey oatey 212 electively moves to terminal 2O with an allied engineer 202, and they both move simultaneously on the second (2O-4O) and third turns (4O-6U), but follow different move paths (engineer 202 dotted; donkey oatey 212 dashed). The companion engineer 202 may electively be removed or left at terminal 6U after the third turn. Conversely, on the ninth move (7P×10G) the allied engineer 202 at donkey oatey's 212 terminal hexagon 101 was electively removed. As illustrated in the figure by the second (2O-4O) and third (4O-6U) turns, and among many of the other moves depicted, the donkey oatey 212 game-piece passes over all move paths (typically two separate paths) to its terminal. Allied game-pieces may be removed from all move lines as discussed above. During the second turn (2O-4O), for example, the engineer's 202 movement line allows the allied nix 201 at 6O to be removed from the field 100, but the donkey oatey's 212 movement line allows elective removal of the allied pirouette 205 at 3P and tor mentor 207 at 3N.

The movement sequence for donkey oatey 212 stated above is generally absolute, but there are two exceptions. First, if the donkey oatey 212 and the drone 200 occupy the same hexagon 101, the game-pieces may, in some cases, be moved in concert according to the move rules of the drone 200. Second, different movement rules also apply when the donkey oatey 212 occupies the hexagon 101 which also supports the Neutral Knocker 102 (discussed below). These moves are discussed further below. Moreover, these moves may resolve a donkey oatey 212 stalemate (also, a nix 201 may swap hexagons 101 with a stalemated donkey oatey 212 after advancing to the end of its column, as discussed above).

In addition to its movement abilities outlined above, donkey oatey 212 has passive features which influence the other game-pieces. For instance, a rival game-piece occupying an allied terminal hexagon 101 may not be removed if the rival donkey oatey 212 is occupying a hexagon 101 anywhere in the movement line (i.e., the move may not be made).

It should be noted that the donkey oatey 212 and other game pieces moving in concert may remove both allied and rival game pieces during a single turn. This mechanism does not violate the previous rule stated above, since one piece is deemed to capture the rival piece at the terminal hexagon 101 and the other piece is deemed to remove the allied pieces in the move line.

c. Alternating Between Foxy Vix'n 211 and Donkey Oatey 212.

The foxy vix'n donkey oatey game-piece 210 is a split personality—the foxy vix'n 211 (heads); and, the donkey oatey 212 (tails). Each personality has different attributes and characteristics. To determine which personality manifests first, a coin may be tossed at the beginning of the game with heads and tails of the coin representing the respective personality. Throughout the game, the personalities may alternate, or change, based on various events. For example, personality may switch after: the passing of a pre-set amount of time (periodic personality switching); the happening of an event (such as the removal of an opponent's game-piece from the field 100); or the placement of the foxy vix'n donkey oatey 210 within a certain section of the field 100—for instance, the left half of the field 100. Any of these factors may be incorporated as the only means for switching personality or one of many means for switching personality during a given contest.

7. Neutral Knocker 102.

Figure 4E:
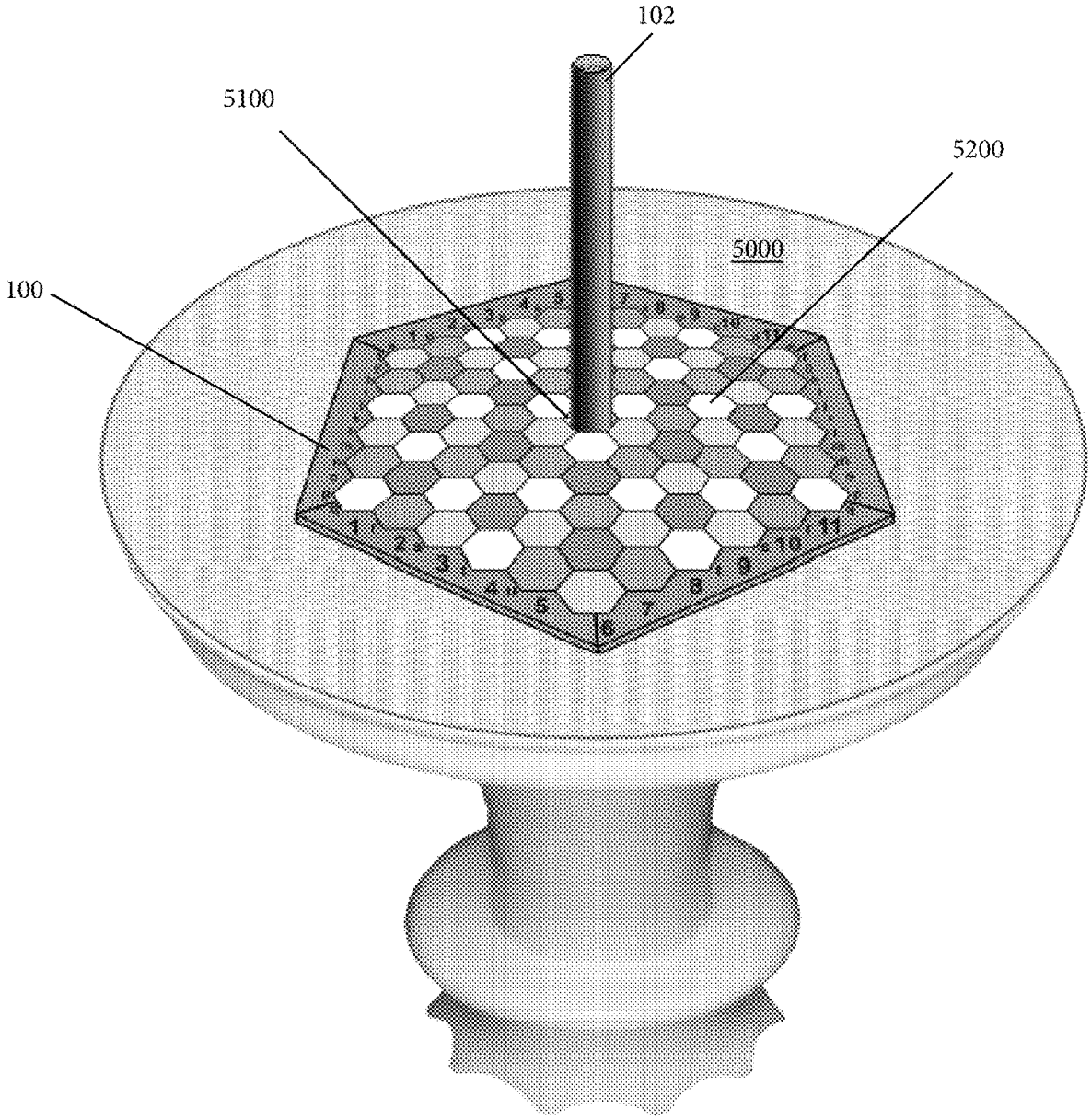
FIG. 4E depicts movement of the neutral knocker 102 game-piece.
Figure 4F:
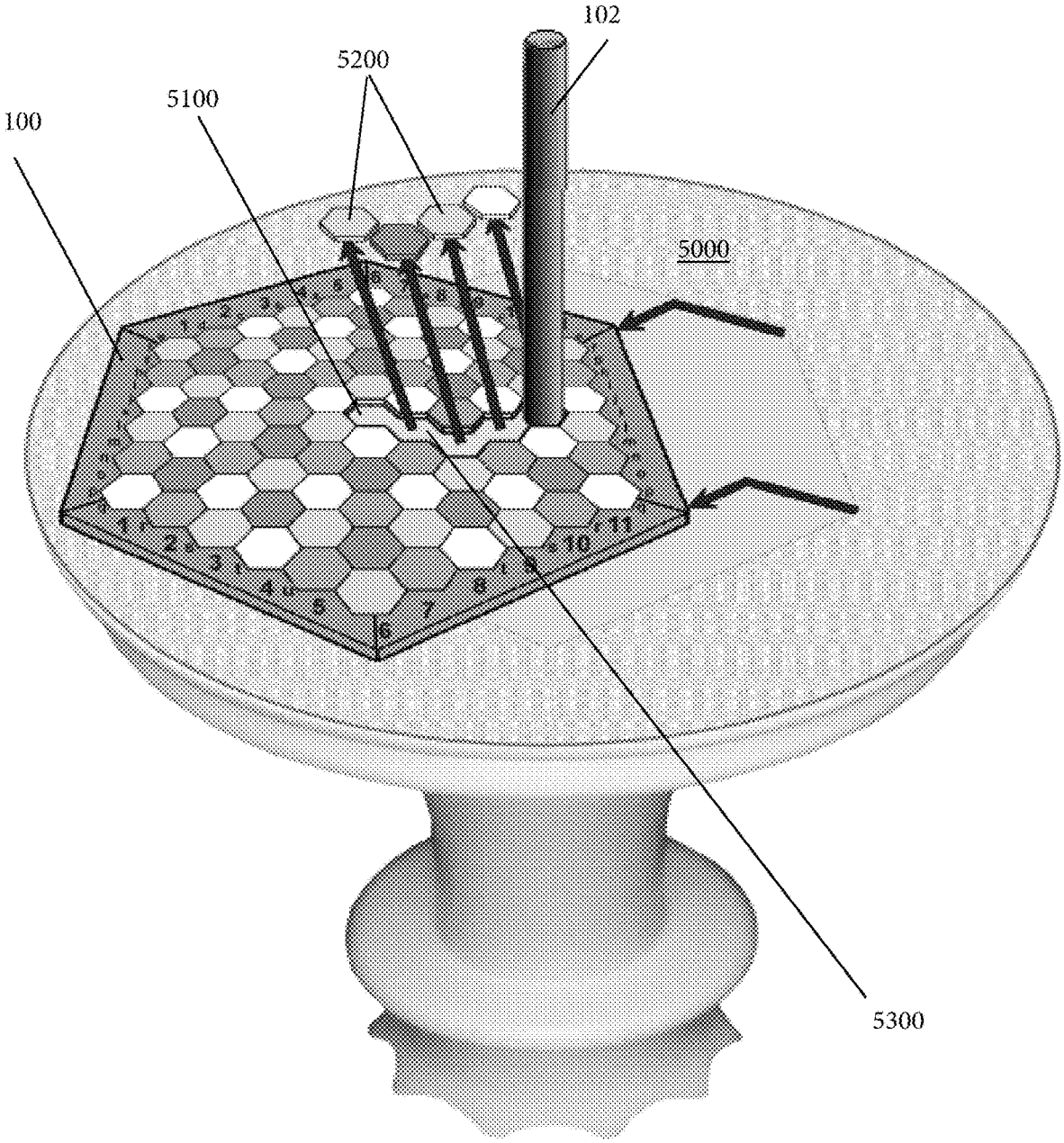
FIG. 4F depicts movement of the neutral knocker 102 game-piece.
Figure 4G:
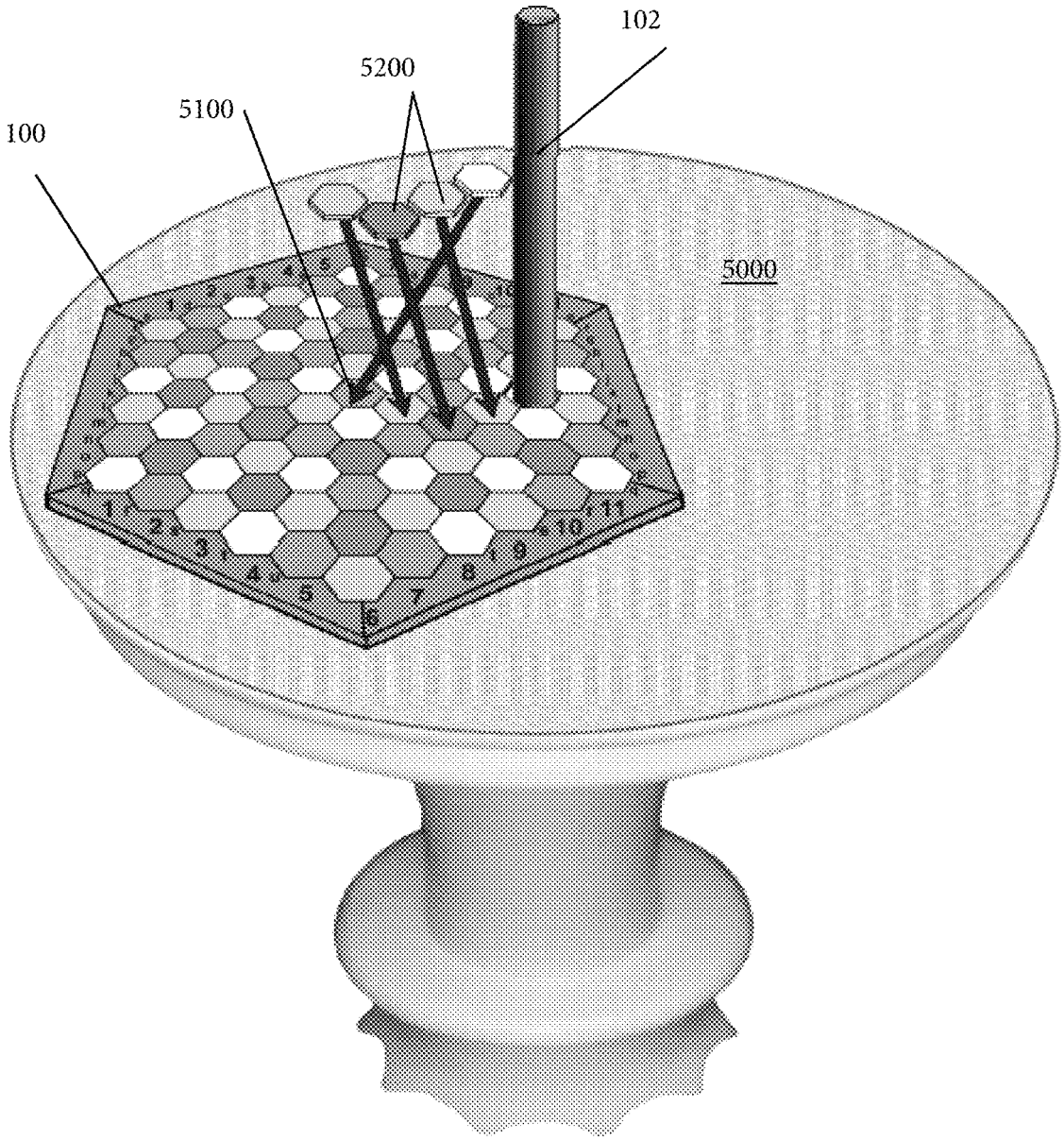
FIG. 4G depicts movement of the neutral knocker 102 game-piece.

The neutral knocker 102 is a single game-piece with loyalty to neither the light nor the dark game-piece sets. The neutral knocker 102 is usually identified by a hexagonal or cylindrical pillar, as depicted in FIGS. 4A through 4D. As shown in FIGS. 4E through 4G, the neutral knocker 102 may be moved relative to the field by either player, at least once per game. The role of the neutral knocker 102 is to occupy a single hexagon 5100 on the field 100 whereby both rival and allied game-piece movements are blocked passively thereby. In other words, non-neutral game-pieces may not occupy or "jump" (from any of the 12 directions either "across lines," or "along lines") the neutral knocker 102 and its occupied hexagon 5100.

The neutral knocker 102 renders the playing field 100 dynamic, since the accessible terminal hexagons 101 for any given game-piece change with neutral knocker 102 movements. In other words, the accessible hexagons 101 for any given game-piece movements are usually different after neutral knocker 102 movement than before. The neutral knocker 102 may neither capture nor be captured. The neutral knocker 102 is not usually upgradable, as previously defined.

As stated above, although initially placed at the center of the board 6K, the neutral knocker 102 may be moved relative to the field 100 a preset number of times per player per contest, (for example, one move apiece). FIGS. 4E through 4G illustrate one embodiment of a game play field 100 and neutral knocker where the field is moved relative to the neutral knocker 102 during game play. Referring first to FIG. 4E, the neutral knocker 102 may suitably be cylindrical and secured to a table 5000 in an upright position and passed through the center hexagon 5100 of the field 100. In one embodiment, the neutral knocker may be defined by an umbrella pole of common patio furniture tables. In this embodiment, the field 100 is generally hexagonal and defines a pattern of ninety tessellated hexagons 101, and an empty center hexagon 5100, situated whereby six of the tessellated hexagons 101 occupy each side of the hexagonal field 100. Separate regular polygons (here ninety) are tessellated within (optional) perimeter frame pieces [having (optional) column and row markings] around a neutral knocker 102 [Here, centered around a table umbrella pole]. Thus, the center hexagon 5100 is absent from a normally ninety-one hexagon 5200 tessellated field 100. As shown in FIG. 4F, in this particular embodiment, the hexagons 5200 are individually removable so that when adjacent hexagons 5200 are removed, the neutral knocker 102 may be guided through the path 5300 to a new location relative to the field 100 e.g. as the field 100 is shifted over the table 5000. For example, a player for a move of the neutral knocker 102 may opt to remove one or more polygons 5200 so that the whole game board assemblage 100 may be slid across the table top 5000 until the board 100 location chosen by the player for the missing polygon 5200 is occupied by the neutral knocker 102. The two crooked arrows of FIG. 4*f* show the directions and distance the game board 100 traveled on the move. Referring now to FIG. 4G, the game play pieces may be replaced in the void 5300 so that the neutral knocker 102 now occupies a different positioned relative to the field 100. The field is still defined by ninety hexagons 5200 that are available for game play. After (or intermittently as) the whole game board assemblage 100 has been slid across the table top 5000 until the board location chosen by the player for the missing polygon 5200 is occupied by the neutral knocker 102, the removed polygons 5200 are replaced in the game board 100. The polygon that was in the position now occupied by the neutral knocker 102 is placed in the last unoccupied game board space. As shown, the two faces of each polygon may be two different colors. During a game, all active game-pieces must be positioned on a hexagon 101, and generally, the contestants manipulate the location of their game-pieces, per turn, by moving pieces between a start hexagon and a terminal hexagon.

In a different embodiment, tessellated polygons may also be inlayed or glued to and cover the whole table top. In this case, the corner positions of the extent of the game board at game start could be marked with tape, coins, etc. A game board move would then consist of moving every one of the game pieces the same number of spaces to the same relative end space they would have been at if moved together on an assembled game board. The game board corner marker's would also be moved. If game size is scaled up (ex.: from inches to feet), the neutral knocker could be a flagpole, tether ball pole, etc. and the polygons could be commercially available pavers of clay, concrete, etc.

If not inlayed, a game board move could be achieved by moving individual pavers from one game board edge and tessellating them along other edges until the desired configuration in relation to the stationary obstruction is achieved. The game board pieces would also be moved as appropriate. Moving all of the individual game board polygons & game pieces to the correct move end positions may in itself be a major intellectual exercise. In scaled up games, moving large game pieces and board polygons, especially those made of concrete or stone, offers an opportunity for much needed physical exercise [interspersed within long periods of inactivity] that is more context appropriate than Chess Boxing.

The neutral knocker 102 influences the movement of the other game-pieces. First, any movement line of any game-piece except donkey oatey 212 and foxy vix'n 211 will effectively terminate at the neutral knocker 102 (i.e., game-pieces beyond the neutral knocker 102 may not be captured and desirable destination hexagons 101 beyond the neutral knocker 102 are not viable). Second, the neutral knocker 102 affects donkey oatey 212 movement when the neutral knocker 102 and the donkey oatey 212 occupy the same hexagon 101. For example, if the neutral knocker 102 has not previously been moved by either contestant, both it and the donkey oatey 212 may be moved to any of the unoccupied hexagons 101 on the field 100, thereby disregarding and temporarily suspending the movement sequence of the donkey oatey 212. For another example, if the neutral knocker 102 is being moved for the second time while associated with the same donkey oatey 212 as the first neutral knocker 102 move, there are two possibilities: (1) where there has been no interim separation between the two game-pieces (neutral knocker 102 and donkey oatey 212) since the first neutral knocker 102 move, the move must follow both the donkey oatey 212 and neutral knocker 102 move rules; and, (2) where there has been interim separation between the two game-pieces since the first neutral knocker 102 move, both game-pieces may be moved to any empty hexagon 101 as if the first neutral knocker 102 move. Finally, if the neutral knocker 102 and the rival donkey oatey 212 occupy the same hexagon 101, an allied move may transfer the neutral knocker 102 to a hexagon 101 supporting the allied donkey oatey 212 while simultaneously removing the rival donkey oatey 212 formerly sharing the hexagon 101 with the neutral knocker 102.

8. Donkey Oatey 212 Aspects: Morx 300.

A morx 300 is an aspect of the donkey oatey 212. Each set of allied and rival game-pieces suitably feature six morx 300 game-pieces: (1) the down-feather 301; (2) the up-feather 302; (3) the way-down-feather 303; (4) the bitten-feather 305; (5) the inverted feather 304; and, (6) the lightning-bolt feather 306 (see FIGS. 4*a* and 6). These morx 300 are respectively identified by an upside down feather, a right side up feather, a stringy feather, a two-pronged feather, a side notched feather, and a lightning-bolt feather. The morx 300 are placed on host monads thereby upgrading a monad to one of six astrix 400: a doodle 401; an odd 402; a noodle 403; and earful 404; and off 501; and, an offul 502 (see FIG. 6). The mechanisms for upgrading a host monad into an astrix 400 are discussed further below.

The morx 300 are not usually immediately available to the contestants. Rather, each morx 300 has a triggering event that activates the morx 300 for attachment to a host monad. The triggering events are as follows: the down feather 301 activates upon the first rival capture of an allied donkey oatey 212 or foxy vix'n 211; the up-feather 302 activates upon the first rival capture of an allied doodle 401; the way-down-feather 303 activates upon the first rival capture of an allied odd 402; the bitten-feather 305 activates if elected to replace an allied nix 201 that has advanced to the end of its column; the inverted feather 304 activates after the first rival capture of an allied tor mentor 207; and, the lightning-bolt feather 306 activates if elected to replace an allied nix 201 that has advanced to the end of its column. To create an astrix 400, the morx 300 generally need not attach to a monad immediately upon activation because the upgrade can usually be accomplished during a subsequent turn, or even during the opponents turn.

a. Combining Morx 300 With Monads: Astrix 400 That Follow Foxy Vix'n 211 Rules but Donkey Oatey 212 Movement Sequence.

Figure 6:
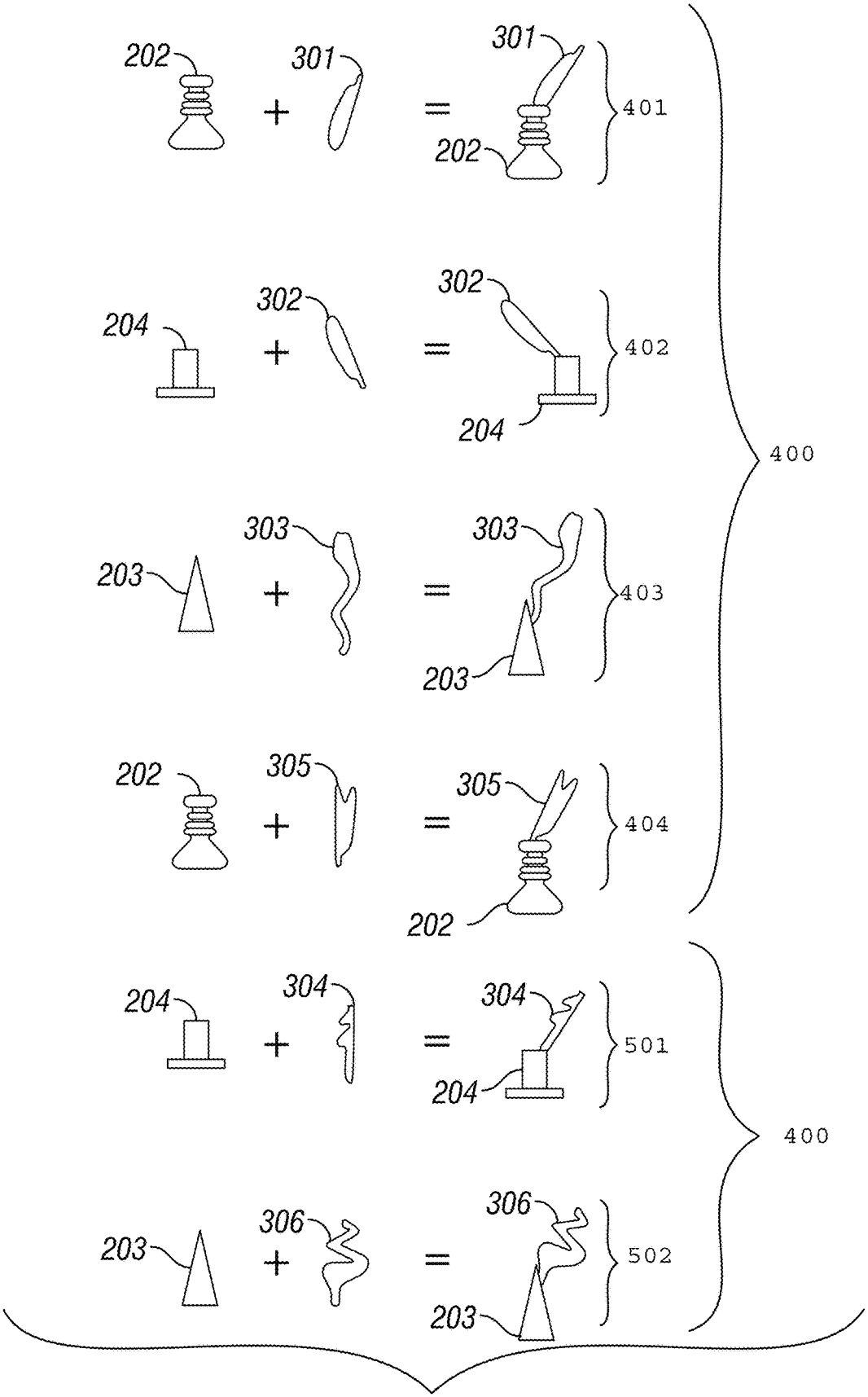
FIG. 6 depicts game piece upgrades.

FIG. 6 depicts the upgrade of a monad to an astrix 400 via a morx 300. Four of the six astrix 400, follow donkey oatey movement sequences, but foxy vix'n 211 movement rules. The morx 300 may move away from its host game-piece if, as a turn and following the move rules, another monad occupies the terminal hexagon 101. If the morx 300 transfers to a new host game-piece, the astrix 400 abilities shift with the morx 300.

i. The Doodle 401.

The doodle 401 is the result of a monad/down feather 301 combination (see FIG. 6). Upon activation, the down feather 301 may then, or later, be placed on any un-captured monad. The resultant doodle 401 follows foxy vix'n 211 rules, but donkey oatey 212 movement sequencing, starting as if the fourth donkey oatey 212 move.

ii. The Odd 402.

The odd 402 is the result of a monad/up-feather 302 combination (see FIG. 6). Upon activation, the up feather 302 may then, or later, be placed on any un-captured monad. The resultant odd 402 follows foxy vix'n 211 rules, but donkey oatey 212 movement sequencing, starting as if the third donkey oatey 212 move.

iii. The Noodle 403.

The noodle 403 is the result of a monad/way-down-feather 303 combination (see FIG. 6). Upon activation, the way-down-feather 302 may then, or later, be placed on any un-captured monad. The resultant noodle 403 follows foxy vix'n 211 rules, but donkey oatey 212 movement sequencing, starting as if the fifth donkey oatey 212 move.

iv. The Earful 404.

The earful 404 is the result of a monad/bitten-feather 305 combination (see FIG. 6). Upon activation, the bitten-feather 302 must immediately be placed on its host game-piece and the exchanged nix 201 must be removed from the field 100. The resultant earful 403 follows the rules of the noodle 403.

b. Combining Morx 300 with Monads. Astrix 400 that follow Tor Mentor 207 Rules.

FIG. 6 depicts the upgrade of a monad to an astrix 400 via a morx 300. Two of the six astrix 400, follow tor mentor 207 rules. The morx 300 may move away from its host monad if, as a turn and following the move rules, it will land on another monad occupying its terminal hexagon 101. If the morx 300 transfers to a new host game-piece, the astrix 400 abilities shift to that new host game-piece.

i. The Off 502.

The off 502 is the result of a monad/inverted-feather 304 combination (see FIG. 6). Upon activation, the inverted-feather 302 may then, or later, be placed on any un-captured monad. The resultant off 502 follows tor mentor 207 move rules.

ii. The Offul 503.

The offul 503 is the result of a monad/crooked-20 feather 306 combination (see FIG. 6). Upon activation, the crooked-feather 306 must immediately be placed on its captured or un-captured host monad and the exchanged nix 201 must be removed from the field 100. The resultant offul 503 follows the rules of the off 502.

Obtaining a Victory. In the game of the present application, victory may be achieved in one of two ways: (1) strategizing a "perfect fix" on the first threat of capture to the opponent's drone 200 (see below); and, (2) if a "perfect fix"

is not possible on the first threat of the opponent's drone 200, by collecting more points than the opponent.

A "fix" is the endangerment of a rival drone for capture. When such a configuration is attained by a contestant, the "fixing" contestant typically informs the "fixed" contestant. An imperfect fix occurs where the endangered drone 200 has the ability to escape in a single additional move. A "perfect fix" is the result of any game-piece configuration throughout the field 100 which results in an opposing drone 200 necessarily occupying a terminal hexagon 101 of the allied game-pieces, despite the opportunity for an additional move. Fixing the opponents drone 200 is the only manner by which points are earned.

1. A Point Victory.

Points are generally used to determine the victorious contestant. One point is usually awarded for "perfect fixes" (i.e. where the drone 200 necessarily occupies a terminal hexagon 101 of the rival game pieces). Four-elevenths of a point is generally awarded for non-perfect "fixes" (i.e., where the drone 200 is endangered, but may move away or may be protected from the endangerment). Seven-elevenths of a point is awarded if the imperfectly fixed contestant elects to end the game rather than attempt an escape. Points may be tabulated on a game-play record. TABLE 5 is an example of such a sheet.

2. The Perfect Fix On the First Drone 200 Endangerment.

Obtaining a perfect fix is an absolute victory if accomplished on the first endangerment of a drone 200 for capture. Victory results in the stated scenario since game movement will thereby terminate, and only the fixing party will have earned a point.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not ply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

INCORPORATIONS BY REFERENCE

This document hereby incorporates by reference the book titled "KIDDOS' BOOK of SIX in A DREAM® IN SIX DEMENTIANS" by Martin Emory O'Connor, published 2016 with Sir Real Pressure, Ink. P.O. Box 45, Lakeside, Calif. 92040. A copy of this book has been submitted with the initial filing.

All original claims submitted with this specification are incorporated by reference in their entirety as if fully set forth herein.

PAPER "SEQUENCE LISTING"

Not applicable.

I claim:

1. A table comprising:

a top surface that has a surface area with a co-axial hole, said top surface supported by at least one pedestal or leg;

a pole passed through said co-axial hole in said top surface such that it defines a fixed upright post in the center of the table;

a game board defined by a hexagonal perimeter and eighty six tessellated hexagonal tiles arranged within the perimeter on the top surface of the table in a pattern of ninety one tessellated hexagonal spaces;

where game board covers less than all of the surface area of the top surface of the table when arranged on the top surface of the table;

where five of the hexagonal spaces are empty while eighty six of the hexagonal spaces are occupied by the eighty six tessellated hexagonal tiles;

where the hexagonal perimeter is defined by six perimeter frame pieces that form a hexagonal frame around said upright post wherein the frame confines said eighty six tessellated hexagonal tiles within said pattern while said eighty six tessellated tiles are occupying said eighty six hexagonal spaces;

where said five of the hexagonal spaces that are empty are side-by-side and centrally positioned within the pattern to define a path that is confined within the perimeter of the game board; and, where the fixed upright post is run-through one of the five empty hexagonal space at the center of the pattern so that the game board is movably positioned on the top surface of the table wherein moving the board causes the upright post to follow the path defined by the five empty hexagonal spaces.

2. The Table of claim 1 where four of the five empty hexagonal spaces have been filled with four hexagonal ties after the hexagonal frame and confined eighty six tessellated hexagonal ties have been moved from a first position on the top surface to a second position on the top surface by:

moving the game board over the top surface of the table so that the upright post follows the path defined by the five empty hexagonal spaces;

obtaining four more hexagonal tiles;

placing the four hexagonal tiles in four of the five empty hexagons to define a game board defined by ninety tessellated hexagonal tiles plus one empty hexagonal space;

obtaining at least two sets of rival game-pieces respectively movable between a start and a terminal hexagon by at least two rival contestants;

wherein the game board that is defined by ninety tessellated hexagonal tiles plus one empty hexagonal space arranged so that the game board defines a pattern of ninety one tessellated hexagons where the empty hexagonal space is positioned at the center of the pattern, wherein six of the tessellated hexagons occupy each side of the hexagonal field and movement of game-pieces is only permitted inside the perimeter of the hexagonal area;

utilizing a the pole passing through the table as a neutral game piece;

assembling the tiles of the game board on the table so that the neutral game piece is run-through the empty hexagonal space at the center of the pattern;

removing one or more of the hexagonal tiles from the game board to create a path empty of tiles within the game board;

moving the board over the table relative to the fixed neutral game-piece that is affixed to the table so that the fixed neutral game-piece moves relative to the board along the path empty of tiles;

reassembling said one or more tiles of the game board that were removed to create the path empty of tiles so that the game board is defined by said ninety tessellated hexagonal tiles plus said one empty hexagonal space arranged now so that the game board defines a pattern of ninety one tessellated hexagons where the empty hexagonal space is positioned off center of the pattern;

wherein said relative movement of said neutral game-piece alters said movability of said rival game-pieces;

moving rival game-pieces on a turn by turn basis based on the type of game-piece and pre-set rules;

capturing said rival game pieces as a consequence of game play; and earning points by endangering a hierarch game-piece.

3. A method of playing a board game according to claim 2 wherein each set of rival game pieces comprises one drone, eleven nixes, seven monads, one pirouette, two bureaucrats, one tor mentor, and one foxy vix'n donkey oatey.

4. A method of playing board game according to claim 3 wherein the first two sets of rival game-pieces feature at least one split personality game-piece with sequential movement durations that shift between said personalities according to the pre-set rules.

5. A method of playing a board game according to claim 4 wherein each set of rival game-pieces features at least one upgradable game-piece.

6. A method of playing a board game according to claim 5 wherein said movability of said game-pieces is between hexagons by any manner within the list of movements consisting of: across lines, along lines, shallow angle across lines, shallow angle along lines.

7. A method of playing a board game according to claim 6 where the game-piece with the split personality is the foxy vix'n donkey oatey.

8. A method of playing a board game according to claim 7 wherein victory is awarded to one of the contestants based on points earned.

9. A method of playing a board game according to claim 8 wherein the rules of the game permit:

the drone to move one hexagon in any direction "across lines" or "along lines;" the nixes to move two hexagons in a first move and one hexagon in a subsequent move columnarly "across lines" toward the opponent;

the monads to move one or more hexagons in any direction "along lines";

the pirouette to move one or more hexagons in any direction "across lines";

the bureaucrats to move one or more hexagons in any directions "across lines";

the tor mentor to move one or more hexagons in any direction "Across lines" or "along lines";

the foxy vix'n to move in any direction straight "across lines," or "shallow angled" "across lines" and may "jumps" non-moving game-pieces; and donkey oatey to move in any direction straight "across lines," or "shallow angled" "across lines" and may "jumps" non-moving game-pieces.

10. A method of playing a board game according to claim 9 wherein the movement duration for foxy vix'n is preset and depends on the number of times foxy vix'n has previously been moved; the foxy vix'n's first movement is one hexagon; second, two hexagons; third, three hexagons; fourth, four hexagons; and, five hexagons for any move thereafter.

11. A method of playing a board game according to claim 10 wherein the movement duration for the donkey oatey is preset and depends on the number of times donkey oatey has previously been moved; the first and second movements both electively one or two hexagons; its third, four hexagons; fourth, three hexagons; its fifth, five hexagons; its sixth, six hexagons; its seventh, four hexagons; its eighth, eight hexagons; its ninth, six hexagons; its tenth, five hexagons; eleventh, three hexagons; twelfth, four hexagons; thirteenth, two hexagons; and fourteen, begin a repeat of the sequence starting at the third move.

12. A method of playing a board game according to claim 11 where the personalities of the foxy vix'n donkey oatey may alternate based on various events.

13. A method of playing a board game according to claim 12 wherein:

the drone is initially positioned at the point of the field behind all other game-pieces;

the nixes are initially positioned opposingly to the rival game-pieces, one per column in front of the other allied game-pieces;

the monads are initially positioned behind the nix at the respective corners of the field in the same relative positions as, but not mirrored to, the rival monad game-pieces;

the pirouette is initially positioned behind the nix and among the monads, in the same relative positions as, but not mirrored with, the equivalent rival game-pieces;

the bureaucrats are initially positioned behind the nix and among the monads, in the same relative positions as, but not mirrored with, the equivalent rival game-pieces;

the tor mentor is initially positioned behind the nix and next to the allied drone; and the foxy vix'n donkey oatey is initially positioned on the player's left side, behind the nix, and among the monad and bureaucrat game-pieces.

14. A method of playing a board game according to claim 13 that features the pole as the neutral game piece which has loyalty to neither opponent and wherein the game board may be moved relative to the pole by either player, at least once per game so that both rival and allied game-piece movements are blocked passively thereby said pole.

15. A method of playing a board game according to claim 14 wherein the sets of game pieces further comprises six morx game pieces.

16. A method of playing a board game according to claim 15 wherein the pre-set rules permit the upgrade of a monad to an astrix by placing a morx on a monad.

17. A method of playing a board game according to claim 16 wherein one point is awarded when the drone necessarily occupies a terminal hexagon of a rival game piece, four elevenths of a point is awarded if the drone is endangered, but can move away from the danger, and seven elevenths is awarded if the drone is endangered and the contestant elects to end the game rather than escape.

18. The game board of claim 1 where the pole is defined by the shaft of an umbrella.

* * * * *